US005848946A

United States Patent [19]

Stillinger

[11] Patent Number: 5,848,946

[45] Date of Patent: Dec. 15, 1998

[54] FILLED, DEFORMABLE BLADDER AMUSEMENT DEVICE WITH INFINITELY CHANGEABLE PLIABILITY AND TACTILITY CHARACTERISTICS

[76] Inventor: Scott H. Stillinger, 15360 Robin Ann La., Monte Sereno, Calif. 95030

[21] Appl. No.: 700,593

[22] Filed: Aug. 14, 1996

[51] Int. Cl.[6] ..... A63B 43/00

[52] U.S. Cl. ..... 473/594

[58] Field of Search ..... 473/594, 597, 473/570, 163, 165, 215

[56] References Cited

U.S. PATENT DOCUMENTS

| | | | |
|---|---|---|---|
| 450,759 | 4/1891 | Peterson . | |
| 3,407,406 | 10/1968 | Werner et al. . | |
| 3,459,179 | 8/1969 | Olesen . | |
| 3,480,280 | 11/1969 | Gamertsfelder | 473/594 |
| 3,552,044 | 1/1971 | Wiele . | |
| 3,601,923 | 8/1971 | Rosenberg . | |
| 3,734,498 | 5/1973 | Seiersen . | |
| 3,748,779 | 7/1973 | Cherk et al. . | |
| 4,011,611 | 3/1977 | Lederman . | |
| 4,151,994 | 5/1979 | Stalberger, Jr. | 473/594 |
| 4,252,910 | 2/1981 | Schaefer . | |
| 4,337,944 | 7/1982 | Massino | 473/597 |
| 4,448,418 | 5/1984 | McNeil | 473/594 X |
| 4,598,909 | 7/1986 | Ventura et al. | 473/594 |
| 4,717,158 | 1/1988 | Pennisi | 473/570 |
| 4,728,551 | 3/1988 | Jay . | |
| 4,872,676 | 10/1989 | Townsend . | |
| 4,943,066 | 7/1990 | Lathim et al. | 473/594 X |
| 4,944,363 | 7/1990 | Osher et al. . | |
| 4,952,190 | 8/1990 | Tarnoff et al. | 473/594 X |
| 4,986,549 | 1/1991 | Kuhtic et al. | 473/594 X |
| 5,190,504 | 3/1993 | Scatterday . | |
| 5,335,907 | 8/1994 | Spector | 473/594 |
| 5,350,342 | 9/1994 | Scatterday . | |
| 5,421,874 | 6/1995 | Pearce . | |
| 5,518,237 | 5/1996 | Bellehumeur | 473/594 X |
| 5,566,953 | 10/1996 | Arriola et al. | 473/594 |

*Primary Examiner*—Steven Wong
*Attorney, Agent, or Firm*—Kolisch, Hartwell, Dickinson, McCormack & Heuser

[57] ABSTRACT

An engageable, manipulable, infinitely configurable deformation structure including a fluid-impervious bladder-like structure, and a composite filler mixture in the form of plural independent particles thinly coated with a liquid lubricant disposed in a sealed condition within the bladder-like structure, with that filler material substantially but less than completely filling the enclosure in the sense that gas-occupying spaces, or the like, are distributed throughout the enclosure, between adjacent particles, and between particles and the bladder-like structure.

37 Claims, 4 Drawing Sheets

FILLED, DEFORMABLE BLADDER AMUSEMENT DEVICE WITH INFINITELY CHANGEABLE PLIABILITY AND TACTILITY CHARACTERISTICS

BACKGROUND AND SUMMARY OF THE INVENTION

The present invention relates to a hand-engageable and manipulable, infinitely configurable deformation structure which, in the preferred embodiment of the invention specifically illustrated and described herein, takes the form, generally, of a ball-like amusement device having, nominally, a size which resides somewhere between that of a conventional golf ball and that of a conventional beach ball. In addition to unique tossing and catching qualities of this invention, it also offers novel and unique qualities involving changeable tactility characteristics as well as changeable pliability and "molding-into-various-shapes" characteristics. According to several ways of viewing the invention, it is referred to herein alternatively as a change pliability structure, and as a ball-like amusement object or device.

While those who are skilled in the relevant art recognize that for many years new contributions to the field of ball-ike amusement devices have been continuous and abundant, it seems as if, in very recent years, there has been an intense exploration aimed at developing strikingly new and very different sorts of such things which offer performance characteristics setting them distinctly apart from their generic predecessors. For example, in about 1987, OddzOn Products, Inc. of Campbell Calif., introduced the now world-famous Koosh® ball device which is fully described and illustrated in U.S. Pat. No. 4,756,529. Those who are familiar with the Koosh® ball are well aware of its many special offerings—including unique tossing, catching, landing without bouncing, and general pleasant (tactile) handling characteristics.

The same inventor of that widely acclaimed device now makes yet a new distinctive contribution to generally the same field of art with the invention which is set forth, disclosed, described, illustrated, and claimed in the present case.

Proposed according to a preferred embodiment of the invention, and in relation to one way of viewing the features in the invention, is an engageable, manipulable, infinitely configurable deformation structure which includes a fluid-impervious enclosure defined by (1) a bladder-like structure (bladder), and (2) a composite filler mixture in the form of plural independent particles thinly coated with a liquid lubricant. The particles and coating lubricant are all disposed in a sealed condition within the enclosure under circumstances with this filler mixture substantially but less than completely filling the enclosure, in the sense that gas-occupying spaces are distributed throughout the enclosure between adjacent particles, and between particles and the bladder-like structure. The preferred embodiment of the invention which is described and illustrated herein has generally a ball-like configuration, although it will be readily apparent to those skilled in the art that the unique characteristics of the invention are not confined to ball-like structures.

It is important to note that gas-occupying spaces, or like-compressibility materials, are distributed throughout and within the interior of the bladder, for it is this feature, interalia, which gives, and in relation to the other components, supportedly enhances, various unique performance and handling qualities of the invention.

While the structure just described can be prepared in such a fashion that, once fabricated, the bladder is forever sealed, yet a further feature of the a modified form of the invention is that there is included a bi-directional, openable/closeable valve that allows the user to change the overall volume of gas contained within the bladder, and in this regard, thus to vary the pressure of such gas infinitely within a range preferably that brackets from somewhat above to somewhat below atmospheric pressure. This feature of the invention allows the user, in an infinite sense, to change the apparent pliability of the overall structure, thereby to change dramatically its tactility and "moldability" characteristics, and in the bargain, to change also the way in which it performs when it is used for throwing and catching, for example.

Yet another way, among several other ways which will be discussed below, of viewing the invention, is that it includes a fluid-impervious enclosure defined by a bladder, such as is mentioned above, and a composite filler blend in the form of plural independent particles, and an at least partially compressible medium, including a liquid lubricant that thinly coats such particles, with this filler blend disposed in a sealed condition within the bladder and substantially occupying the totality of the volume of the enclosure.

Thus in the ways that the present invention are characterized herein, the "mixture" and the "blend" referred to are different in their respective attributes. Further explaining, the invention, as first described above, includes a bladder containing a composite filler mixture (particles and lubricant) along with distributed gas-occupying spaces, and as second described above, includes a bladder containing a composite filler blend (particles and a partially compressible surrounding medium). Such a partially compressible surrounding medium can be formed in a variety of ways, including employing (a) gas-occupying spaces immediately adjacent the lubricant-coated particles and between the particles and the bladder, (b) by compressible material units blended with the particles and the lubricant, and (c) by a combination of such units and gas-occupying spaces.

DETAILED DESCRIPTION OF THE INVENTION

Figure 1:
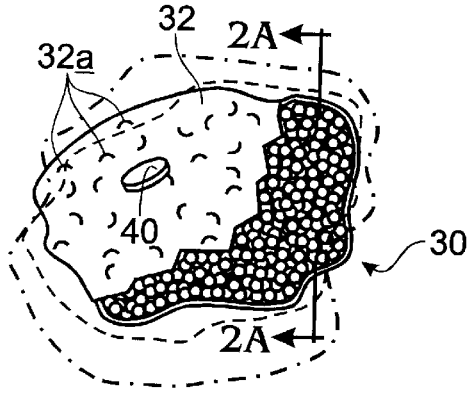
FIG. 1 is a view illustrating a preferred embodiment of the present invention, which embodiment takes the form of a ball-ike amusement device or object that is infinitely deformable and configurable (note the "pebbly" texture). In solid lines, the device is illustrated with one deformed configuration, and a portion thereof has been broken away to illustrate details of the interior. In addition, in dashed lines and in dash-dot lines, respectively, two different deformed configurations are illustrated.
Figure 2A:
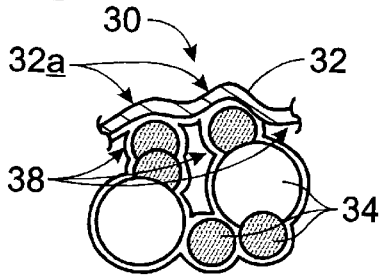
FIG. 2A is an enlarged, fragmentary, cross-sectional detail taken generally along the line 2A—2A in FIG. 1.

Turning now to the drawings, and referring first of all to FIGS. 1, 2A, 2B and 3, indicated generally at 30 in FIGS. 1 and 2A is a ball-like amusement object, or device, constructed in accordance with the present invention—such device also being referred to herein generally both as a deformation structure, and as a change-pliability structure which nominally has an undefined specific shape. Device 30, as pictured in FIGS. 1 and 2A, includes a bladder 32, which is also referred to herein both as a fluid-impervious enclosure, and as a bladder-like structure (bladder), which bladder has a flexible, balloon-like characteristic, complete with a neck (discussed a little bit later herein) which is used for filling it. Bladder 32 preferably is formed of an elastomeric material, such as latex rubber, or the like. In device 30 bladder 32 has a wall thickness of about 0.5-mm. Bladder 32 may be opaque, translucent or transparent, and certain interesting features of the invention will later be described herein in conjunction with employing a bladder having one of the latter two mentioned, non-opacity characteristics. While device 30 as shown herein has a ball-like quality, other kinds of shapes are contemplated, such as human or animal figures, faces and heads, and so on.

Bladder 32 is filled herein with a composite filler mixture which includes a plurality of solid, non-hollow, uniform-size, spherical, independent particles 34 which are a thinly coated with a liquid lubricant 36. In particular, the bladder illustrated in FIG. 1 has been filled just to non-stretch capacity by the lubricant-coated particles. Particles 34 are formed of solid polyvinylchloride (PVC), each with a diameter of about 2-mm and a hardness in the range of about 35 Shore-A to about 90 Shore-A. While such uniform-size spheres, made from the identified material, have been chosen for illustration in device 30, it should be recognized that particles of other sizes may be used, may be made of other suitable materials, and may be hollow or not. Further it should be recognized that the term "solid" herein is used not only to refer to very rigid particles, but also to particles which might be somewhat foamy or spongy. Particles 34 are collectively referred to both as a solid core material, and as an infinitely reshapeable mass of dimensional material. Preferably, particles 34 have major dimensions (diameters in the illustration now being described) which lie within the range of about 1-mm to about 2-cm. Bladder 32, when formed into a sphere has a diameter of about 60-mm. Preferably, the diameter range for filled bladder 32 is bracketed by the diameter of the usual golf ball, and that of the usual beach ball.

Liquid lubricant 36 herein takes the form of corn syrup—a material which is nondestructively compatible both with latex rubber and with polyvinylchloride. It is also a material which performs well to lubricate the particles for relative internal (inside the bladder) motion when the device is squeezed and otherwise manipulated. Other liquid lubricants which have been tried with success, and which offer the necessary material-compatibility and motion-enhancing qualities include both glycerine, and a mix of glycerine and corn syrup. Certainly, other liquid lubricants may be found to work as well.

An important feature of the present invention is that the composite filler mixture which has just been described substantially but less than completely fills the interior volume of the bladder, in the sense that distributed within the interior of the bladder are plural gas-occupying spaces, such as those illustrated at 38 in FIG. 2A. these spaces are distributed throughout the bladder between adjacent particles and between particles and bladder 32. It is the presence of such gas-occupying spaces, or the like, which offers, among other things, very interesting infinite deformabiltiy/pliability and other handling and performance characteristics which distinguish device 30. These characteristics would not be fully or appreciably present in the absence either of such gas-occupying spaces, or of some other medium, which allows for compressibility. Put another way, if the entire interior volume of the bladder were fully filled with just noncompressible particles and lubricant, many of the enticing features of the invention would be absent. Among these interesting features is that device 30 exhibits practically no bounce when it strikes a solid surface.

Where, as is preferred, gas-occupying spaces are present, the pressure within these spaces ideally resides within a range which extends from somewhat below to somewhat above atmospheric pressure. Remarkably, even slightly different pressures within this range lead to appreciably different handling and performance characteristics. Generally speaking, as gas pressure is lowered, device 30 becomes more dense and rigid. It progressively resists change (i.e. progressively more force is required to effect a shape change), and tends to hold its changed-to new shape more tenaciously.

Device 30 as illustrated in FIGS. 1 and 2A has been prepared in such a fashion that its internal gas pressure is slightly below atmospheric pressure. As a consequence, gas spaces 38 are accordingly compressed to below atmospheric pressure, and the bladder slightly presses against adjacent particles to produce, from the point of view of a handling user, the pebbly finish which is apparent in FIGS. 1 and 2 at the location designated 32*a*, which finish results from the natural contour of the bladder as its lays over, presses against, and telegraphs the physical presence of adjacent individual particles.

The quality of infinite deformabiltiy and reshapeability is illustrated and suggested in FIG. 1 by the shapes for device 30 depicted in the dashed lines and in the dashed-dot lines in this figure. Handling and reshaping of the device produces a pleasing tactile massage experience. The tactile qualities of device 30 are dynamic in nature. The particles inside move about—"appearing and disappearing" and thus stimulating the hand and fingers. Smooth surfaced particles such as spheres 34 easily and relatively smoothly and silently move next to and past one another. More angular, faceted particles—to be mentioned later—make more noise and tend to snap and pop relative to one another as they move. Also such handling and reshaping, when the device is used for throwing and catching, changes dramatically from throw to throw its aerodynamic, and thus path-of-flight, characteristics. Put another way, the aerial travel path followed by an oddly shaped device like device 30 can be quite unpredictable.

Figure 2B:
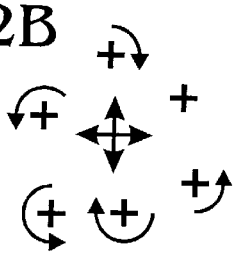
FIG. 2B is a vector diagram which is related, as will be explained below, to the fragmentary detail shown in FIG. 2A.

As mentioned, manipulating and deforming of device 30 is accommodated by rolling and translating of adjacent particles, and such rolling and translating, for the seven particles specifically illustrated in FIG. 2A, is suggested by the double-ended straight, and by the curved, arrow vectors illustrated in FIG. 2B. The small cross-marks appearing in FIG. 2B depict the centers of the particles illustrated in FIG. 2A. Incidentally, the reason that particles in FIG. 2A appear in different sizes is that only two of them are shown in full size, and the remaining five are shown in section, where sectioning of these five particles takes place at different distances from the centers of the respective particles. Manipulating and deforming of device 30, in addition, results in moving about and reshaping of the gas-occupying spaces, as one can well imagine. It will be apparent that changes in internal gas pressure will affect the "normal" abutment/contact forces between adjacent particles. Lower pressures increase such forces and larger pressures decrease such forces.

Figure 2C:
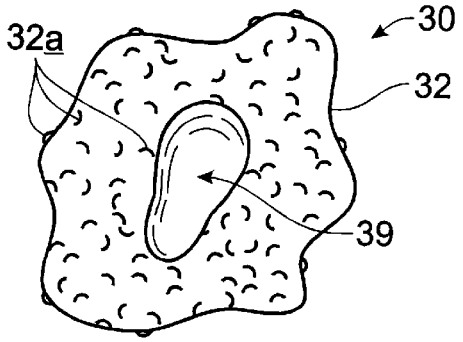
FIG. 2C illustrates the tendency of the device of FIG. 1 which, as will be explained, has interior gas-occupying spaces, with these spaces being somewhat below atmospheric pressure, to retain a deformed shape.

Accordingly, in relation to the pressure within the gas-occupying spaces, one can state that the lower the gas pressure, the denser and less pliant becomes the device (as has already been mentioned), whereas the greater the gas pressure, the more fluidly pliant becomes the device. The mentioned changes in normal forces directly affect this situation. In FIG. 2C bladder 32 has been squeezed to produce, in the side facing the viewer, a deep thumbprint 39. Because of the below-atmospheric condition of gas within the bladder, device 30 tends to retain this deformed "thumb-printed" condition. In addition, the thumbprint area tends not to telegraph the pebbliness created elsewhere by particles 34, probably because of the natural presence of restoration tension in the bladder material. Where gas pressure is atmospheric or above, while a thumbprint-like depression might somewhat be retained in the filler material, the bladder probably will not show it much, or at all.

Figure 3:
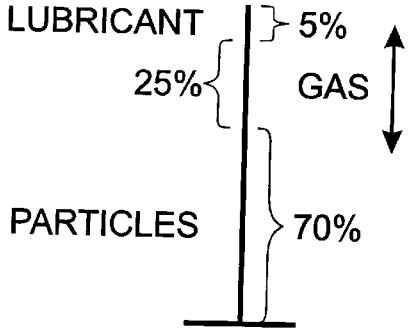
FIG. 3 is a vertical bar graph which illustrates, for story-telling purposes, selectively variable conditions of inflation/deflation and filling of the bladder in the invention.

FIG. 3 graphically illustrates how the makeup of what fills the inside of bladder 32 can be viewed, and here one can see with respect to device 30 that, of the total internal volume within bladder 30, a fairly large percentage (about 70%) is occupied by the filler particles, a smaller percentage (about 25%) is occupied by gas, and yet a smaller percentage (about 5%) is occupied by the liquid lubricant. The small double-ended vertical arrow on the right side in FIG. 3 represents the selectability of the total volume occupied by gas which changes in accordance with the selected internal gas pressure. More will be said about this feature shortly. Of course, changes in gas occupancy volume change the respective volume occupancies of the particles and the lubricant.

Figure 4:
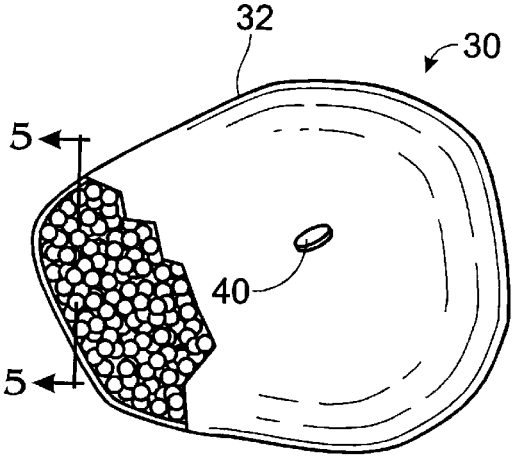
FIG. 4 is similar to and on about the same as FIG. 1, except that it illustrates the device of FIG. 1 in a condition having different internal gas pressure.
Figure 5:
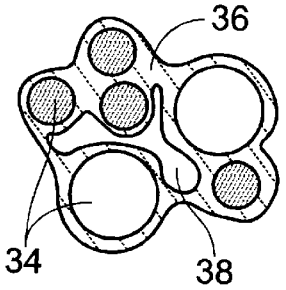
FIG. 5, which is on about the same scale as FIG. 2A, is an enlarged, fragmentary, cross-sectional detail taken generally along the line 5—5 in FIG. 4.

FIGS. 4 and 5, which are like FIGS. 1 and 2A, respectively, illustrate the condition of device 30 under circumstances with gas in the gas-occupying spaces being inflated and pressured to slightly above atmospheric pressure. Under this condition, the outer surface of the bladder does not readily telegraph the surface topographies of immediately adjacent interior particles, and thus has the more smooth surface quality seen in FIG. 4. The gas-occupying spaces are larger than those previously illustrated, and this can be seen for the single gas-occupying space 38 shown in FIG. 5, with this space compared with those illustrated in FIG. 2A.

Completing a description of device 30, the filling neck of its bladder is, after complete construction of the device, tied into a knot 32*a* (FIG. 6) which is preferably concealed by a knot hider, such as the knot hider shown generally at 40.

Figure 6:
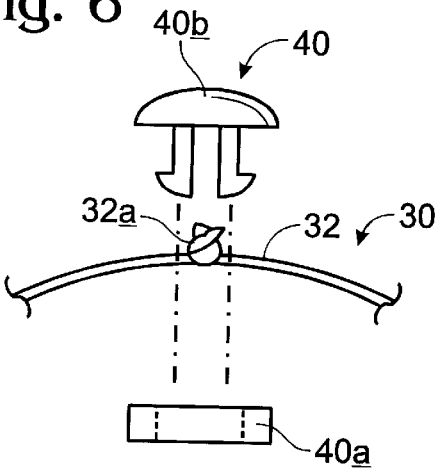
FIGS. 6 and 7 are related to one another, and illustrate what is referred to herein as a knot hider (two pieces), with FIG. 6 showing the two-piece knot hider about to be installed, and FIG. 7 showing the knot hider fuilly installed.
Figure 7:
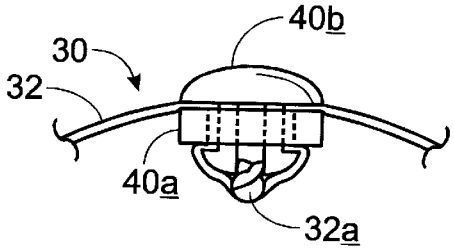

Referring now to FIGS. 6 and 7 in conjunction with describing knot hider 40, in FIG. 6, bladder 30 is shown with its filler neck knotted as mentioned at 32*a*, and knot hider 40 is seen to be a two-piece device including an interior (inside the bladder) collar 40*a* and low-profile, outside, a snap button 40*b*. Through careful manipulation, collar 40*a* is inserted into the interior of bladder 30 through the filler neck just prior to tying knot 32*a*, and by suitable hand manipulation, button 40*b* is pressed downwardly over knot 32*a* and into collar 40*a* whereby its claw feet 40*c* snap and lock in place on the underside of collar 40*a* as illustrated in FIG. 7. Clearly, knot hider 40 is not a necessary piece of structure, but aesthetically it is a preferred way of presenting device 30.

Figure 8:
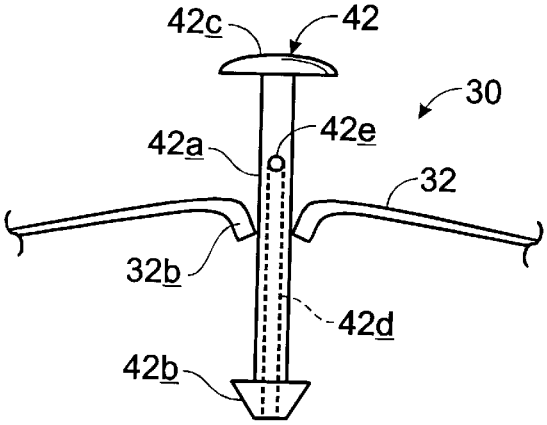
FIG. 8 is a fragmentary view illustrating one form of bidirectional inflation/deflation valve which may be incorporated in the device of the invention.

Device 30 as so far described has been spoken of as one in which a desired internal gas pressure has been preselected for all time (leakage being ignored). In a modified version of such a device, the same is equipped with a bidirectional gas inlet/outlet valve which extends through a suitable opening in the bladder (which might be the filler neck), and such a valve is illustrated in FIG. 8 at 42. Valve 42, as depicted in FIG. 8, includes an elongated central stem which joins with a truncated conical foot 42*b* and a button-like cap 42*c*. Extending into stem 42*a* from the base of foot 42*b* is an elongate fluid passage 42*d* which rises in the stem to communicate with a laterally extending fluid port, such as port 42*e*. Valve 42 extends through neck 32*b* shown in FIG. 8. The valve stem is slidably received in the neck, and can be pushed down to close the valve or pulled out to open the same. In FIG. 8 the valve is shown open. With the valve open, obviously gas can be introduced into or withdrawn from the interior of bladder 32, thus to change the pressure and volume of gas within the bladder. With the pressure appropriately selected and adjusted, the valve is closed by pressing it downwardly into the bladder to the point where cap 42*c* seals neck 32*b*. Pressure within the interior of the bladder naturally tends to maintain the valve and pinch opening relatively sealed. With the presence of such a valve, obviously, the user can at will selectively change the pliability and handling characteristics of device 30 merely by varying the volume and pressure of internal gas in the gas-occupying spaces.

Figure 9:
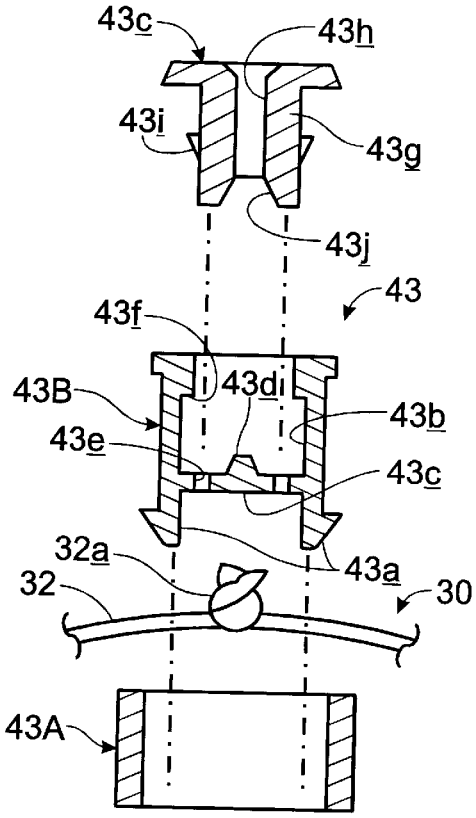
FIG. 9 is a fragmentary view illustrating another form of such inflation/deflation valve, which also functions as a knot hider.

Turning attention now to FIG. 9, indicated generally at 43 is a three-piece assemblage which is shown disassembled in FIG. 9. Assemblage 43, which functions both as a knot hider and as a gas inlet/outlet valve, includes a collar 43A which, like previously mentioned collar 40*a*, is placed within bladder 32 immediately adjacent knot 32*a* as shown, a central member 43B and a slider cap 43C. Central member 43B includes claw feet 43*a* and an upwardly facing cavity 43*b* which is divided from a downwardly facing cavity by a wall 43*c*. Wall 43*c* includes an upwardly facing, central, frustroconical projection 43*d* and plural through wall ports, such as the port shown at 43*e*. The upper portion of cavity 43*b* is defined by a downwardly facing shoulder shown at 43*f* Slider cap 43C includes a central, downwardly extending stem 43*g* which includes a central fluid passage 43*h*, and laterally outwardly projecting catch devices, such as the one shown at 43*i*. The bottom of passage 43*h* opens to a frustroconical void space 43*j* which matches, and is intended to seat matchingly and sealingly against, projection 43*d*.

Collar 43A is suitably placed inside bladder 32 adjacent knot 32*a* as shown, and then central member 43B is pushed downwardly to drive a knot and the adjacent portions of the bladder downwardly into collar 43A to a condition where feet 43*a* snap beneath and catch the underside of collar 43A to lock these two units in place. Wall 43*c* thus hides knot 32*a*. Next, a sharp implement such as a needle is thrust downwardly through ports 43*e* to create gas passage holes in the bladder, and then slider cap 43C is pressed down until its catches 43*i* become caught beneath shoulder 43*f*. With the slider cap pressed downwardly all the way until it bottoms out, the valve formed by this assemblage is closed. By pulling upwardly on the slider cap, the valve opens, and gas pressure within the bladder can be changed.

Figure 10:
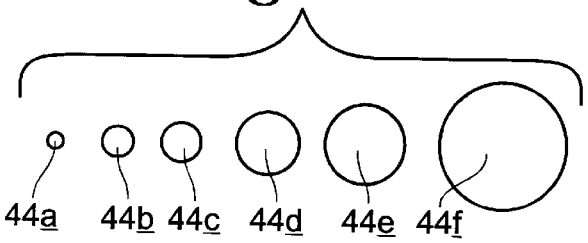
FIGS. 10–19, inclusive, illustrate different kinds of solid filler particles, and in one instance filler strands, which can be employed within the interior of the bladder of the invention.

Moving along now with a description of the invention, particles 34 have been described as being spherical and of uniform diameter. Such particles can also be thought of as being characterized by nonangular outside surfaces. FIG. 10 illustrates a range of spherical particles depicted at 44*a*, 44*b*, 44*c*, 44*d*, 44*e*, 44*f*. Each of these particles is solid and spherical, with particle 44*a* representing one having the smallest preferred major dimension (diameter) of about 1-mm, and particle 44*b* having the largest preferred major dimension (diameter) of about 2-cm.

Figure 11:
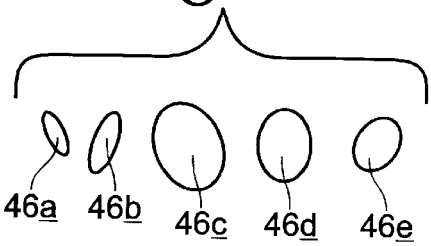

FIG. 11 shows another collection of particles 46*a*, 46*b*, 46*c*, 46*d*, 46*e* which differ in size relative to one another, and which are also characterized by nonanngular outside surfaces that are not spherical, but rather more ovate or egg-shaped. Here, the major dimension which should fall within the range of about 1-mm to about 2-cm is measured along the long axes of these ovate shapes.

Figure 12:
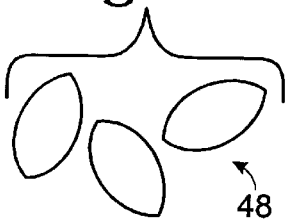

FIG. 12 illustrates a cluster 48 with three, solid, football-shaped particles.

Figure 13:
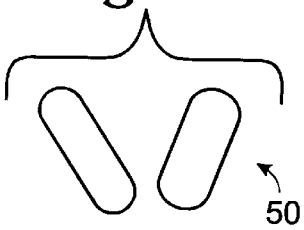

FIG. 13 illustrates a group 50 of two, different-length, capsule-shaped particles. The particles in group 50 have nonangular outside surfaces.

Figure 14:
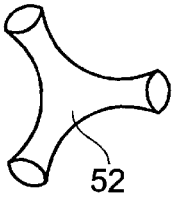

FIG. 14 illustrates a tri-legged particle 52. Particle 52, as well as previously mentioned particles 48, having certain surface angularity or surface discontinuities in relation to their outside surfaces.

Figure 15:
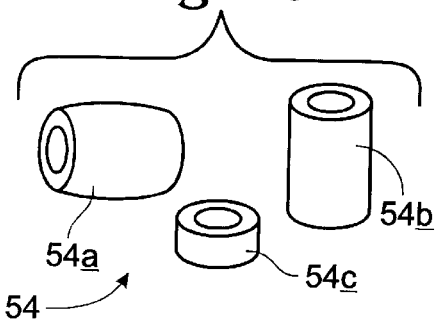

FIG. 15 shows a group of bead-like particles 54 including a hollow, barrel-shaped particle 54*a*, a hollow, elongate, cylindrical particle 54*b*, and a hollow, flat-washer-shaped particle 54*c*.

Figure 16:
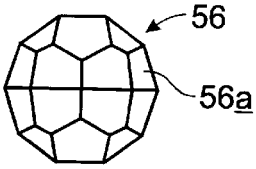

FIG. 16 illustrates a multifaceted particle 56 which includes a plurality of faces, such as face 56*a*.

Figure 17:
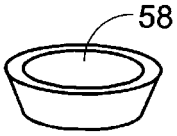

FIG. 17 illustrates at 58 a suctioncup-shaped particle.

Figure 18:
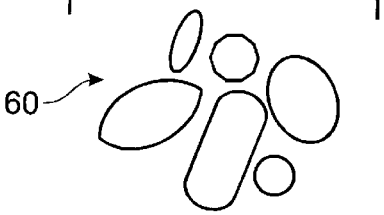

Recalling for a moment the description of device 30 as pictured in FIGS. 1 and 2A, the particles therein were described as all having about the same size. It should be appreciated that variations in the construction of a device like device 30 can include the incorporation of particles which each have basically the same shapes, but a variety or mix of different sizes. Thus, device 30 could be filled with spherical particles that have a range of sizes. It could also be filled with a variety of particles such as those pictured in FIGS. 11, 12, 13, 14, 15, 16, and 17 which are like in shape but different in size. In addition, the bladder in device 30 may be filled, if so desired, not only with particles of different sizes, but also with particles having different shapes and sizes, and this is a situation which is pictured by the group of particles illustrated at 60 in FIG. 18. Where smooth-surfaced particles are employed, they tend to roll and move around and past one another smoothly and silently. Particles such as 52 and 56 move relative to one another more roughly and noisily.

Figure 19:
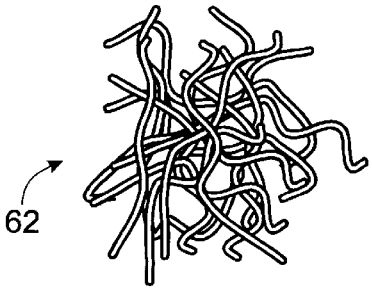

FIG. 19 illustrates a modified solid filler material which takes the form of elongate, flexible and resilient strands of material, such as the tangle of strands shown generally at 62 in this figure. If so desired, these strands may be formed of an elastomeric material such as latex rubber, all, of course, thinly coated with a liquid lubricant like that described earlier.

FIGS. 20–23, inclusive, illustrate another potentially interesting characteristic of the present invention, wherein, in each case, fragmentarily shown bladder 32 is transparent, or at least reasonably translucent, so that it can reveal by visibly showing the interior particles which are most closely adjacent the inside wall of the bladder.

Figure 20:
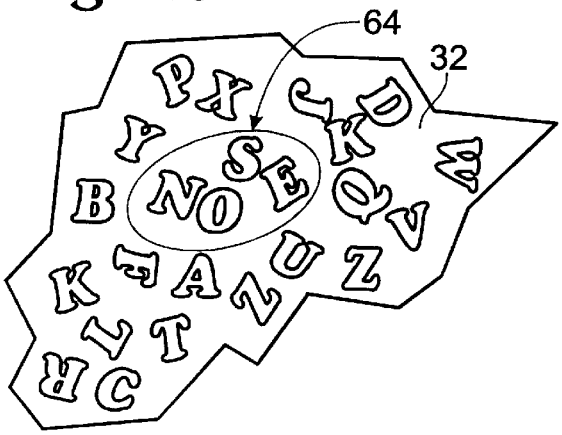
FIGS. 20–23, inclusive, illustrate modifications of the device of the invention wherein the bladder is transparent or translucent, and different kinds of filler particles are employed which may be manipulated and viewed through the bladder.

In FIG. 20 particles inside take the shapes of letters of the alphabet (numbers could also be used), and such an arrangement offers the possibility of creating game activities, such as the activity of attempting to move and manipulate and deform the bladder in such a fashion as to maneuver inside letter particles to form words, etc. Circled at 64 in FIG. 20 is an organization of letters forming the word "nose".

Figure 21:
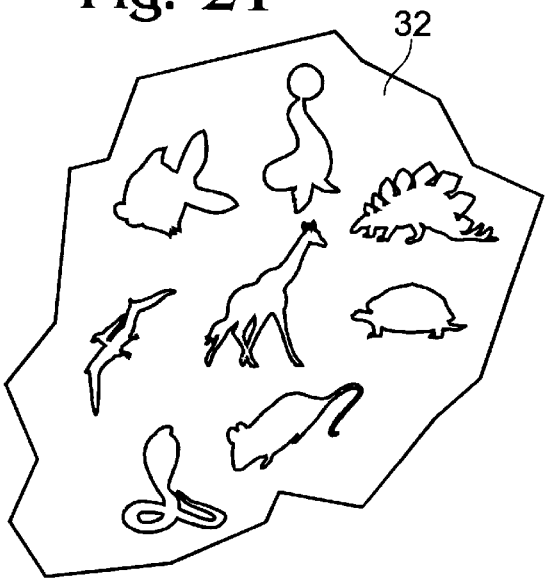

In FIG. 21, the particles within bladder 32 take the form of a potpourri of animal figures.

Figure 22:
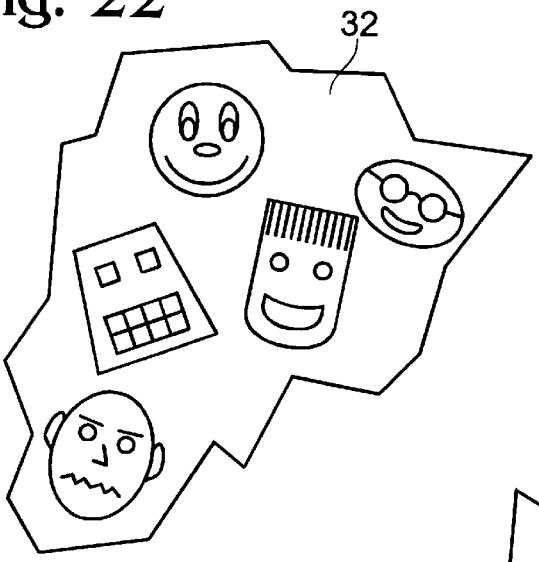

In FIG. 22, the particles within the bladder take the form of a variety of cartoon faces.

Figure 23:
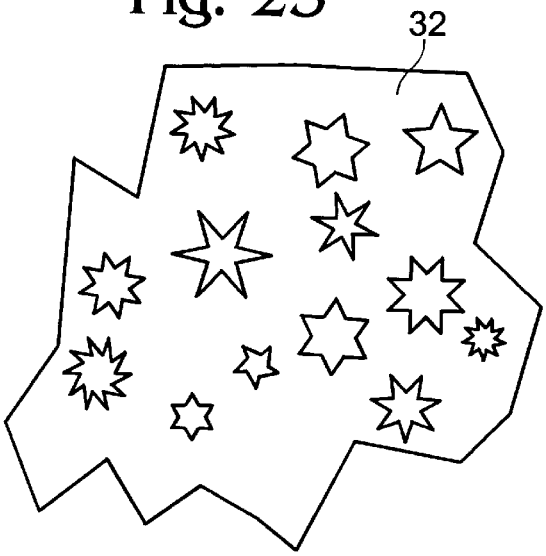

In FIG. 23, the particles within bladder 32 take the form of ornamental objects, such as stars.

Thus the unique hand-manipulable, infinitely deformable structure which forms the core of the present invention has been described in its preferred embodiment form, and in a variety of modifications, all of which herein have been disclosed as ball-like amusement devices. As mentioned earlier, other shapes may be used. By changing, selectively, either at the time of manufacture or through the utilization of an onboard bidirectional valve, pressure residing within gas spaces distributed within the volume of the bladder, the manipulation and pliability and deformability characteristics of the device can be controlled easily. By employing different kinds of like or mixed (either or both in size and shape) filler particles, the tactile characteristic of the device when handled can be made to offer a wide variety of sensations. By assuring that that which substantially fills the interior of the bladder has the quality of compressibility, either through the preferred presence of distributed gas spaces, or through the incorporation of some other material or medium, such as very spongy material, distributed along with more rigid particles, the unique pliability and handling characteristics of the device which distinguish it in it's field are retained.

Accordingly, while a preferred embodiment and a host of variations of the invention have been described herein in particular, other variations and modifications are certainly possible which will come within the scope of the present invention.

It is claimed and desired to secure by Letters Patent:

1. An engageable, manipulable, infinitely moldable and configurable deformation structure comprising a fluid-impervious enclosure defined by a bladder-like structure, and a composite filler mixture in the form of plural, independent particles thinly coated with a liquid lubricant disposed in a sealed condition within said enclosure, in the sense that substantially permanently present, compressible gas-occupying spaces are distributed throughout the enclosure between adjacent particles, and between particles and the bladder-like structure—said filler mixture thus being further characterizable by the substantially continual presence (throughout) of dispersed, separated gas spaces which are each substantially completely surroundingly bounded by liquid lubricant which thinly coats plural, adjacent, associated, distributed particles.

2. The deformation structure of claim 1, wherein said bladder-like structure is flexible.

3. The deformation structure of claim 1, wherein said bladder-like structure is formed of an elastomeric material.

4. The deformation structure of claim 1, wherein said bladder-like structure is transparent enough to allow viewing of said particles.

5. The deformation structure of claim 4, wherein said particles take the form of alphabetic characters.

6. The deformation structure of claim 4, wherein said particles take the form of faces.

7. The deformation structure of claim 4, wherein said particles take the form of animal figures.

8. The deformation structure of claim 4, wherein said particles take the form of ornamental objects.

9. The deformation structure of claim 1, wherein said particles have generally non-angular outside surfaces.

10. The deformation structure of claims 1, 3, or 9, wherein said deformation structure is ball-like in nature.

11. The deformation structure of claims 1 or 3, wherein said particles are faceted.

12. The deformation structure of claims 1, 3, or 9, wherein said particles are generally spherical.

13. The deformation structure of claims 1 or 3, wherein said particles have a suction cup structural characteristic.

14. The deformation structure of claims 1, 3, or 9, wherein said particles are noncompressible.

15. The deformation structure of claims 1 or 3, wherein different ones of said particles have different shapes.

16. The deformation structure of claims 1 or 3, which further includes an openable/closeable gas inlet/outlet valve operatively joined to said bladder-like structure selectively enabling gas flow into and out of said enclosure.

17. An engageable, manipulable, infinitely configurable deformation structure comprising a fluid-impervious enclosure defined by a bladder-like structure, and a composite filler blend in the form of plural, independent particles and an at least partially compressible surrounding medium including (a) a liquid lubricant thinly coating said particles, and (b) plural, permanently widely spatially distributed, lubricant-enveloped gas spaces, disposing in a sealed condition within said enclosure and occupying, collectively, the totality of the volume of the enclosure.

18. The deformation structure of claim 17, wherein the bladder-like structure is formed of an elastomeric material.

19. The deformation structure of claim 17, wherein said particles have generally non-angular outside surfaces.

20. The deformation structure of claims 17, 18, or 19, wherein said deformation structure is ball-like in nature.

21. The deformation structure of claims 17 or 18, wherein said particles are faceted.

22. The deformation structure of claims 17, 18, or 19, wherein said particles are generally spherical.

23. The deformation structure of claims 17 or 18, wherein said particles have a suction cup structural characteristic.

24. The deformation structure of claims 17, 18, or 19, wherein said particles are noncompressible.

25. The deformation structure of claims 17 or 18, wherein different ones of said particles have different shapes.

26. The deformation structure of claims 17 or 18, which further includes an openable/closeable gas inlet/outlet valve operatively joined to said bladder-like structure selectively enabling gas flow into and out of said enclosure.

27. An engageable, manipulable, infinitely configurable deformation structure comprising a fluid-impervious enclosure defined by a bladder-like structure, a composite filler mixture in the form of a plural, independent particles thinly coated with a liquid lubricant disposed within said enclosure, said filler mixture substantially but less than completely filling said enclosure in the sense that substantially permanently present, compressible gas-occupying spaces are distributed throughout the enclosure between adjacent particles, and between particles and the bladder-like structure—said filler mixture thus being further characterizable by the substantially continual presence (throughout) of dispersed, separated gas spaces which are each substantially completely surroundingly bounded by liquid lubricant which thinly coats plural, adjacent, associated, distributed particles, and bidirectional valve structure joined to said bladder-like structure and operable to permit the selective introduction and withdrawal of fluid to and from said enclosure, thus to allow the user to change the overall volume of gas within the bladder-like structure, and in doing so to vary the pressure of such gas infinitely within a range preferably that brackets from somewhat above to somewhat below atmosphere pressure, thereby to change its tactility and moldability characteristics.

28. An engageable, manipulable, infinitely configurable deformation structure comprising bladder-like structure means for providing a fluid-impervious enclosure, and composite filler means in the form of solid, independent particles thinly coated with a liquid lubricant disposed in a sealed condition within said enclosure, said filler means being provided for the purpose of substantially but less than completely filling said enclosure in the sense that substantially permanently present, gas-occupying spaces are distributed throughout the enclosure between adjacent particles, and between particles and the bladder-like structure means, said filler mixture thus being further characterizable by the substantially continual presence (throughout) of dispersed separated gas spaces which are each substantially completely surroundingly bounded by liquid lubricant which thinly coats plural, adjacent, associated, distributed particles.

29. An engageable, manipulable, infinitely configurable deformation structure comprising a fluid-impervious enclosure defined by a bladder-like structure, and a composite filler mixture in the form of solid, independent, flexible and resilient elongate strands of material thinly coated with a liquid lubricant disposed in a sealed condition within said enclosure, said filler mixture substantially but less than completely filling said enclosure in the sense that gas-occupying spaces are distributed throughout the enclosure in regions between adjacent strands and between strands and the bladder-like structure.

30. The deformation structure of claim 29, wherein said strands are elastomeric.

31. An engageable, manipulable, infinitely configurable deformation structure comprising a fluid-impervious enclosure defined by a bladder-like structure, and a composite filler mixture in the form of solid, independent, flexible elongate strands of material thinly coated with a liquid lubricant disposed in a sealed condition within said enclosure, said filler mixture substantially but less than completely filling said enclosure in the sense that gas-occupying spaces are distributed throughout the enclosure in regions between adjacent strands and between strands and the bladder-like structure.

32. An engageable, manipulable, infinitely configurable deformation structure comprising a fluid-impervious enclosure defined by a bladder-like structure, and a composite filler mixture in the form of solid, independent particles thinly coated with a liquid lubricant disposed in a sealed condition within said enclosure in the sense that substantially permanently present, compressible gas-occupying spaces are distributed throughout the enclosure between adjacent particles, and between particles and the bladder-like structure, with said filler mixture thus being further characterizable by the substantially continual presence (throughout) of dispersed, separated gas spaces which are each substantially completely surroundingly bounded by liquid lubricant which thinly coats plural, adjacent, associated, distributed particles—all under the circumstance that pressure within the enclosure is less than atmospheric pressure.

33. An engageable, manipulable, infinitely configurable deformation structure comprising a fluid-impervious enclosure defined by a bladder-like structure, and a composite filler mixture in the form of solid, independent particles thinly coated with a liquid lubricant disposed in a sealed condition within said enclosure in the sense that substantially permanently present, compressible gas-occupying spaces are distributed throughout the enclosure between adjacent particles, and between particles and the bladder-like structure, with said filler mixture thus being further characterizable by the substantially continual presence (throughout) of dispersed, separated gas spaces which are each substantially completely surroundingly bounded by liquid lubricant which thinly coats plural, adjacent, associated, distributed particles—all under the circumstance that pressure within the enclosure is greater than atmospheric pressure.

34. An engageable, manipulable, infinitely configurable deformation structure comprising a fluid-impervious enclosure defined by a bladder-like structure, and a composite filler mixture in the form of solid, independent particles which have a major dimension no less than about 1-mm thinly coated with a liquid lubricant disposed in a sealed condition within said enclosure, in the sense that substantially permanently present, compressible gas-occupying spaces are distributed throughout the enclosure between adjacent particles, and between particles and the bladder-like structure—said filler mixture thus being further characterizable by the substantially continual presence (throughout) of spaced, separated gas spaces which are each substantially completely surroundingly bounded by liquid lubricant which thinly coats plural, adjacent, associated, distributed particles.

35. An engageable, manipulable, infinitely configurable deformation structure comprising a fluid-impervious enclosure defined by a bladder-like structure, and a composite filler mixture in the form of solid, independent particles which have a major dimension no less than about 1-mm thinly coated a liquid lubricant disposed in a sealed condition within said enclosure, said filler mixture substantially but less than completely filling said enclosure in the sense that gas-occupying spaces are distributed throughout the enclosure between adjacent particles, and between particles and the bladder-like structure—said filler mixture thus being further characterizable by the substantially continual presence (throughout) of spaced, separated gas spaces which are each substantially completely surroundingly bounded by liquid lubricant which thinly coats plural, adjacent, associated, distributed particles.

36. An engageable, manipulable, infinitely configurable deformation structure comprising a fluid-impervious enclosure defined by bladder-like structure, and a composite filler mixture in the form of solid, independent particles thinly coated with a liquid lubricant disposed in a sealed condition within said enclosure, in the sense that substantially permanently present, compressible gas-occupying spaces are distributed throughout the enclosed between adjacent particles, and between particles and the bladder-like structure—said filler mixture thus being further characterizable by the substantially continual presence (throughout) of dispersed, separated gas spaces which are each substantially completely surroundingly bounded by liquid lubricant which thinly coats plural, adjacent, associated, distributed particles, said particles being sized in such a fashion that the presence of two adjacent particles in contact with the inside wall of said enclosure is detectable by normal one-finger human touch.

37. A hand-manipulable, infinitely deformable ball-like amusement object comprising a fluid-impervious elastomeric bladder-like structure formed of latex rubber or the like and defining an enclosure, and a composite filler mixture in the form of substantially spherical, uniform-size particles made of polyvinylchloride with a hardness lying within the range of about 35-Shore A to about 90-Shore A, each having a diameter no less than about 1-mm, thinly coated with a liquid lubricant selected from the group consisting of corn syrup, glycerine, and a blend of corn syrup and glycerine, said filler mixture substantially but less than completely filling said enclosure in the sense that substantially permanently present, compressible gas-occupying spaces, which have a pressure lying within a range which extends from somewhat below to somewhat above atmospheric pressure, are distributed throughout the enclosure between adjacent particles, and between particles and the bladder-like structure—said filler mixture thus being further characterizable by the substantially continual presence (throughout) of dispersed, separated gas spaces which are each substantially completely surroundingly bounded by liquid lubricant which thinly coats plural, adjacent, associated, distributed particles.

* * * * *